US009300072B2

(12) United States Patent
Horiuchi

(10) Patent No.: US 9,300,072 B2
(45) Date of Patent: Mar. 29, 2016

(54) CONNECTOR

(71) Applicant: Sumitomo Wiring Systems, Ltd., Yokkaichi, Mie (JP)

(72) Inventor: Hidefumi Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/595,246

(22) Filed: Jan. 13, 2015

(65) Prior Publication Data

US 2015/0222041 A1 Aug. 6, 2015

(30) Foreign Application Priority Data

Jan. 31, 2014 (JP) ..... 2014-017576

(51) Int. Cl.
*H01R 13/432* (2006.01)
*H01R 13/426* (2006.01)
*H01R 13/436* (2006.01)
*H01R 13/506* (2006.01)

(52) U.S. Cl.
CPC ..... *H01R 13/426* (2013.01); *H01R 13/4364* (2013.01); *H01R 13/506* (2013.01)

(58) Field of Classification Search
None
See application file for complete search history.

(56) References Cited

U.S. PATENT DOCUMENTS 8,029,324 B1 * 10/2011 Yi ..... H01R 13/518 439/745
8,491,326 B2 * 7/2013 Sato ..... H05K 7/026 439/404
2002/0123273 A1 * 9/2002 Lehner ..... H01R 4/2433 439/748
2004/0242083 A1 * 12/2004 Ishiyama ..... H01R 13/4362 439/752
2006/0281351 A1 * 12/2006 Yamaoka ..... H01R 13/62938 439/157
2009/0191747 A1 * 7/2009 Tanaka ..... H01R 13/4365 439/352
2012/0077377 A1 * 3/2012 Han ..... B29C 45/2628 439/587
2012/0088391 A1 * 4/2012 Kataoka ..... H01R 13/506 439/350
2012/0322305 A1 * 12/2012 Uchiyama ..... H01R 13/5208 439/587

FOREIGN PATENT DOCUMENTS

JP 2011-034882 2/2011

* cited by examiner

*Primary Examiner* — Jean F Duverne
(74) *Attorney, Agent, or Firm* — Gerald E. Hespos; Michael J. Porco; Matthew T. Hespos

(57) ABSTRACT

Full lock receiving portions (31) are provided on a widthwise central part of a housing (10), and partial lock receiving portions (28) are provided on opposite widthwise end parts of the housing (10). Full locking portions (68) configured to prevent a movement of a retainer (60) to a full locking position by coming into contact with a facing wall surface of a housing (10) at a partial locking position and prevent the retainer (60) from returning to the partial locking position by being locked to the full lock receiving portions (31) at the full locking position are provided on a widthwise central part of the retainer (60). Partial locking portions (73) configured to prevent the retainer (60) from coming out of the housing (10) by being locked to the partial lock receiving portions (28) at the partial locking position are provided on opposite widthwise end parts of the retainer (60).

8 Claims, 12 Drawing Sheets

CONNECTOR

BACKGROUND

1. Field of the Invention

The invention relates to a connector.

2. Description of the Related Art

Japanese Unexamined Patent Publication No. 2011-34882 discloses a connector with a housing that has cavities arranged side by side in a width direction and a front retainer mounted movably to a partial locking position and a full locking position with respect to the housing. Terminal fittings are inserted into the cavities of the housing from behind. The insertion of the terminal fittings into the cavities is allowed when the retainer is at the partial locking position and the terminal fittings inserted into the cavities are retained when the retainer is at the full locking position.

A full locking recess and a guide projection are juxtaposed in a front-back direction on each of side surfaces of the housing on opposite widthwise ends. Further, a full locking projection and a partial locking projection are juxtaposed in the front-back direction on each of side walls of the retainer on opposite widthwise ends. The partial locking projections are locked to the guide projections when the retainer is at the partial locking position, thereby preventing the retainer from coming out of the housing. The full locking projections are locked to the full locking recesses when the retainer is pushed from the partial locking position to the full locking position, thereby positioning the retainer at the full locking position.

A mold structure for the above-described connector becomes complicated in parts for molding the side surfaces of the housing on the opposite widthwise ends since the full locking recess and the guide projection are juxtaposed in the front-back direction on each of the side surfaces of the housing. Similarly, the mold structure becomes complicated in parts for molding the side walls of the retainer since the full locking projection and the partial locking projection are juxtaposed in the front-back direction on each of the side walls of the retainer.

Contrary to this, the complication of the mold structure can be avoided by providing the full locking recesses and the guide projections on different wall surfaces of the housing and providing the full locking projections and the partial locking projections on different wall surfaces of the retainer. However, unless locking positions of the partial locking projections and the guide projections, and a positional relationship of these with the full locking projections and the like are set properly when the retainer is at the partial locking position, the retainer may inadvertently move to the full locking position.

The invention was completed based on the above situation and aims to prevent a retainer from inadvertently moving to a full locking position while avoiding the complication of a mold structure.

SUMMARY OF THE INVENTION

The invention is directed to a connector, including a housing with cavities arranged side by side in a width direction and configured so that terminal fittings are inserted into the cavities. A retainer is mounted into the housing and is movable to a partial locking position where the insertion of the terminal fittings into the cavities is allowed and a full locking position that is reached by pushing the retainer from the partial locking position and where the terminal fittings inserted in the cavities are prevented from coming out. A full lock receiving portion is provided on a widthwise central part of the housing. Partial lock receiving portions are provided on opposite widthwise end parts of the housing. A full locking portion is provided on a widthwise central part of the retainer. The full locking portion is configured to prevent a movement of the retainer to the full locking position by coming into contact with a facing wall surface of the housing at the partial locking position and prevent the retainer from returning to the partial locking position by being locked to the full lock receiving portion at the full locking position. Partial locking portions are provided on opposite widthwise ends of the retainer and are configured to prevent the retainer from coming out of the housing by being locked to the partial lock receiving portions at the partial locking position.

The full locking portion contacts the facing wall surface of the housing at the widthwise central parts of the housing and the retainer when the retainer is at the partial locking position. Thus, the retainer cannot move to the full locking position when a force accidentally acts to push the retainer at the partial locking position toward the full locking position. A wide retainer may be deflected arcuately so that a widthwise central part of the retainer projects and a locked state of the partial lock receiving portions and the partial locking portions is released easily when a force is applied inadvertently to push the retainer at the partial locking position toward the full locking position. Thus, unintended movement of the retainer to the full locking position is prevented by the full locking portion provided on the widthwise central part of the retainer. Further, the full lock receiving portion and the partial lock receiving portions are provided on different parts of the housing and the full locking portion and the partial locking portions are provided on different parts of the retainer so that a mold structure becomes is less complicated.

Movement of the retainer to the full locking position is prevented by the contact of the full locking portion with a widthwise central part of the front surface of the housing when the terminal fittings are inserted into the cavities from behind and the retainer is mounted into the housing from front and located at the partial locking position. Thus, an inadvertent movement of the retainer to the full locking position can be prevented when an external matter or the like interferes with the retainer at the partial locking position from front.

DETAILED DESCRIPTION

A connector according to an embodiment is described based on the drawings. The connector includes a housing 10 made of synthetic resin, a retainer 60 made of synthetic resin and terminal fittings 90 made of electrically conductive metal. The housing 10 is connectable to an unillustrated mating housing. Note that, in the following description, a side facing the mating housing when connection with the mating housing is started is referred to as a front concerning a front-back direction.

Figure 4:
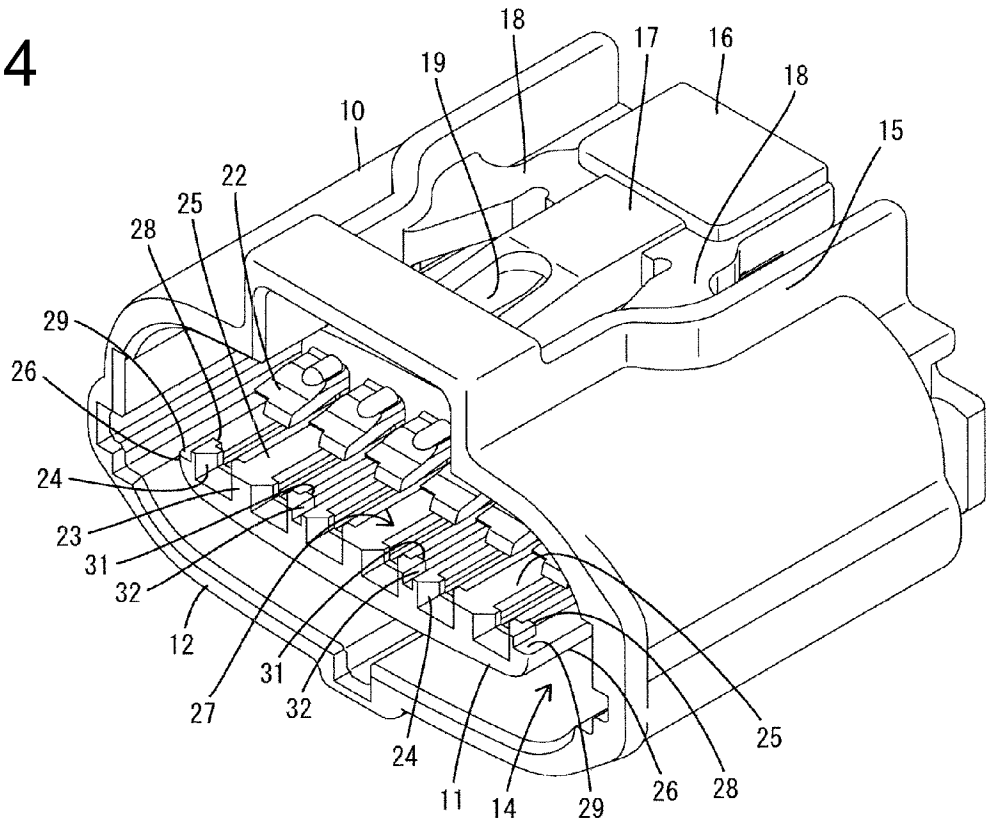
FIG. 4 is a perspective view of the housing.
Figure 5:
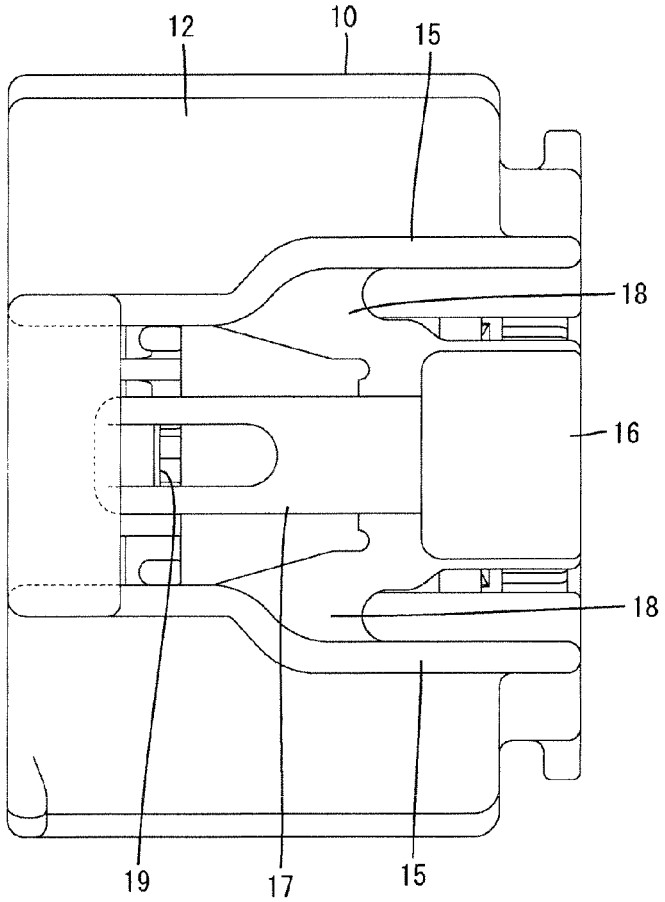
FIG. 5 is a plan view of the housing.
Figure 6:
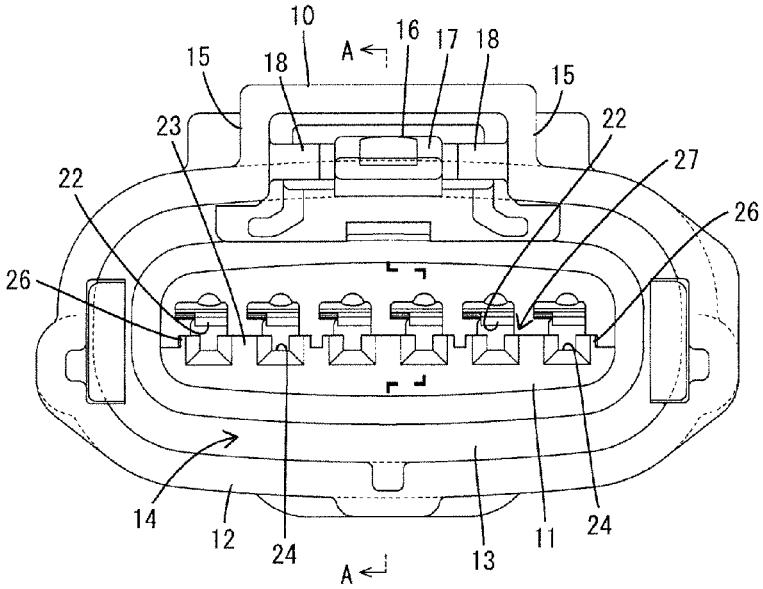
FIG. 6 is a front view of the housing.
Figure 7:
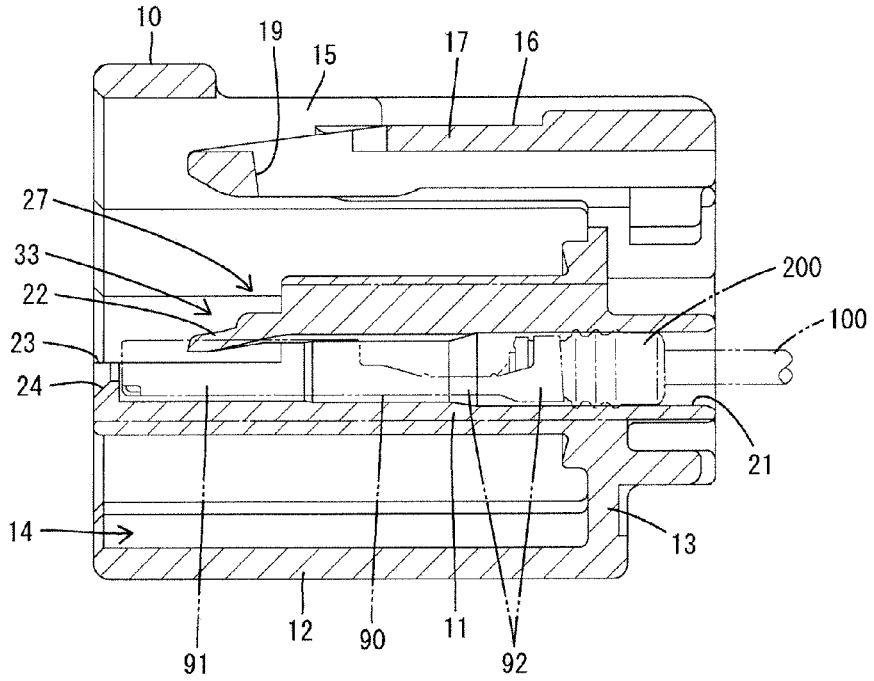
FIG. 7 is a section along A-A of FIG. 6.

The housing 10 includes a block-shaped housing main body 11, and a tubular fitting 12 surrounds the housing main body 11, as shown in FIGS. 4, 6 and 7. Rear ends of the housing main body 11 and the fitting tube 12 are coupled to each other via a coupling 13. A connection space 14 is formed between the housing main body 11 and the fitting tube 12 and before the coupling 13 for receiving an unillustrated receptacle of the mating housing. Further, an unillustrated seal ring is fit before the coupling 13 on the outer surface of the housing main body 11. The retainer 60 prevents the seal ring from coming out forward. Thus, the seal ring is sandwiched resiliently between the housing main body 11 and the receptacle to provide sealing between the two housings when the housings are connected.

Two laterally spaced standing walls 15 are provided on the top of the fitting tube 12, as shown in FIGS. 4 to 8. A deflectable lock arm 16 is provided between the standing walls 15 and above the housing main body 11. The lock arm 16 includes an arm main body 17 extending in the front-back direction and two laterally extending wing pieces 18 couple opposite side edges of the arm main body 17 to inner surfaces of the standing walls 15. The arm main body 17 is vertically pivotable with the wing pieces 18 as supports. As shown in FIG. 7, a lock hole 19 penetrates a front part of the arm main body 17. When the housing 10 is connected to the unillustrated mating housing, an unillustrated lock projection of the mating housing is fit into the lock hole 19 of the arm main body 17, after the lock arm 16 is deflected, to hold the housings in a connected state.

Figure 2:
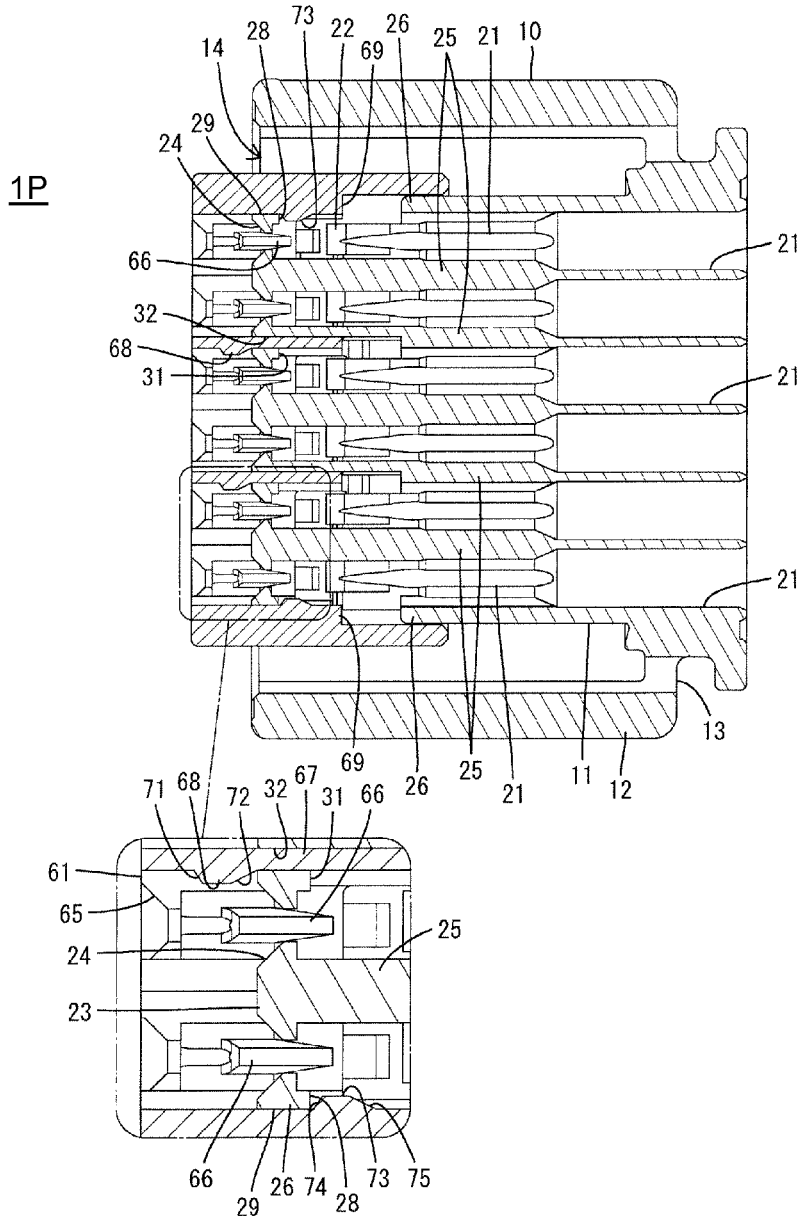
FIG. 2 is a section showing a state where a retainer is held at a partial locking position with respect to a housing.
Figure 8:
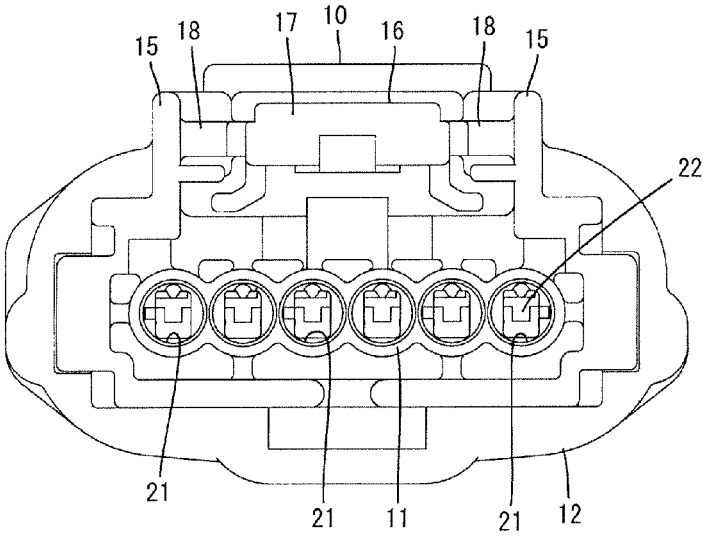
FIG. 8 is a rear view of the housing.

As shown in FIG. 2, cavities 21 extend in the front-back direction in the housing main body 11. As shown in FIG. 8, the cavities 21 are arranged side by side in a row in the width direction in the housing main body 11. A deflectable locking lance 22 projects forward at the upper surface of the inner wall of each cavity 21. As shown in FIG. 7, the terminal fitting 90 is inserted into the cavity 21 and the properly inserted terminal fitting 90 is resiliently retained and locked by the locking lance 22.

As shown in FIG. 7, the terminal fitting 90 includes a tubular box 91 and an open barrel 92 behind the box 91. The barrel 92 is crimped to a wire 100 and a rubber plug 200. The wire 100 connected to the terminal fitting 90 is drawn out from the rear surface of the housing main body 11.

The housing main body 11 has a front wall 23 for partially closing the front ends of the cavities 21, as shown in FIGS. 2, 4 and 7. Tab inserting openings 24 extend through the front wall 23 and can receive tabs of unillustrated mating terminal fittings. A front part of each tab inserting portion 24 is widened toward the front.

As shown in FIG. 2, partition walls 25 are provided in the housing main body 11 between the laterally adjacent cavities 21 and extend substantially along the front-back direction. The front end of each partition wall 25 is coupled unitarily to the front wall 23.

Side walls 26 are provided on opposite widthwise sides of the housing main body 11, as shown in FIG. 2, and define outer sides of the cavities 21 on opposite widthwise sides. A mounting recess 27 is open in a substantially upper half of a front end of the housing main body 11 by cutting parts of the front wall 23, the side walls 26 and each partition wall 25, as shown in FIGS. 4, 6 and 7. Each locking lance 22 is exposed in the mounting recess 27 and the retainer 60 is mounted into the mounting recess 27 from the front.

As shown in FIGS. 2 and 4, partial lock receiving portions 28 are provided on front end parts of both side walls 26 facing the mounting recess 27. The partial lock receiving portions 28 communicate with the mounting recess 27 and penetrate through the side walls 26 in the width direction from the connection space 14 to the cavities 21. Further, a guide groove 29 is provided on the outer surface of each side wall 26 and extends in the front-back direction. A rear end of each guide groove 29 communicates with the partial lock receiving portion 28 and a front end is open on the front surface of the side wall 26.

As shown in FIGS. 2 and 4, full lock receiving portions 31 are provided on front end parts of a pair of partition walls 25 that face the mounting recess 27 and that are located at opposite sides of a widthwise center. Each full lock receiving portion 31 is in the form of a recess communicating with one of the cavities 21 that are adjacent to each other across the partition wall 25 and the mounting recess 27. The front ends of the full lock receiving portions 31 are arranged substantially at the same position as those of the partial lock receiving portions 28 in the front-back direction. The front ends of the full lock receiving portions 31 and the front ends of the partial lock receiving portions 28 are arranged along the width direction and lockable to full locking portions 68 and partial locking portions 73 to be described later. A guide hole 32 is provided in a substantially widthwise central part of each partition wall 25 that has a full lock receiving portion 31. Each guide hole 32 extends in the front-back direction and has a rear end communicating with the full lock receiving portion 31 and a front end open on the front surface of the partition wall 25.

Figure 9:
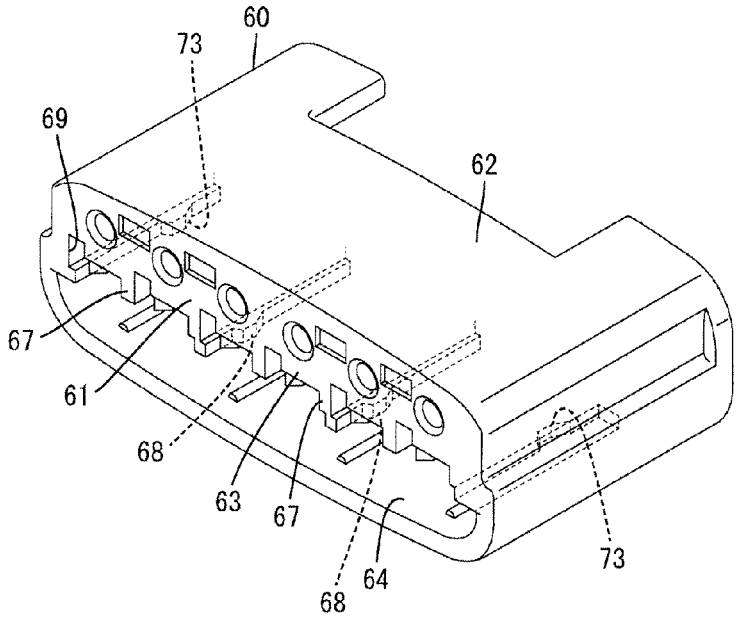
FIG. 9 is a perspective view of the retainer.
Figure 10:
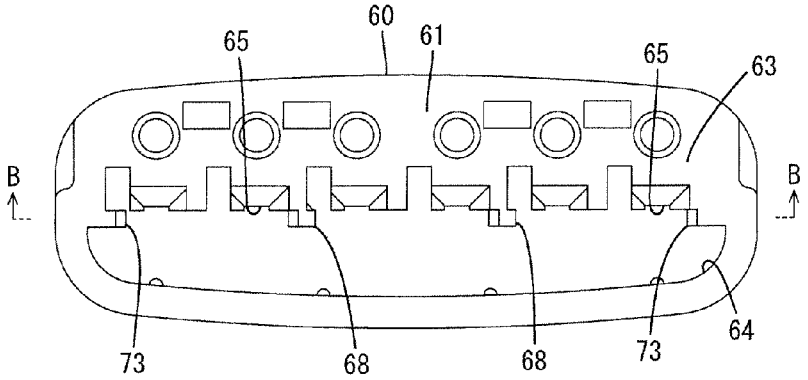
FIG. 10 is a front view of the retainer.

The retainer 60 is a front retainer and includes a front wall 61 and a tubular peripheral wall 62 that projects back from the outer periphery of the front wall 61, as shown in FIG. 9. The front wall 61 includes a covering wall 63 capable of covering a substantially upper half of the housing main body 11 by being fit into the mounting recess 27 and an opening 64 open below the covering wall 63 so that a substantially lower half of the housing main body 11 can fit therein.

Figure 1:
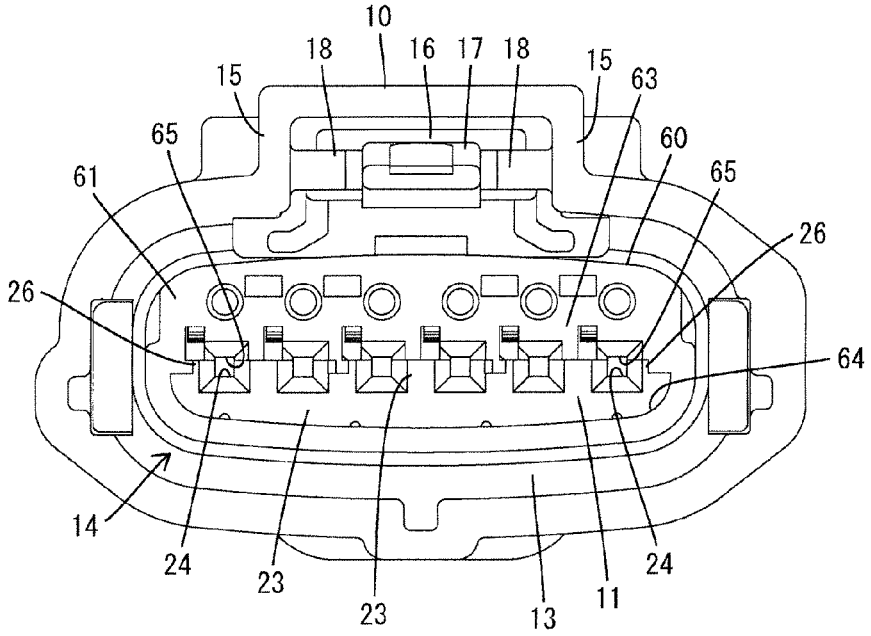
FIG. 1 is a front view of a connector according to an embodiment of the present invention.

The retainer 60 is movable to a partial locking position (see FIG. 2) where the covering wall 63 is arranged while being spaced forward from the housing main body 11 and a full locking position (see FIG. 3) that is reached by pushing the retainer at the partial locking position back so that the covering wall 63 is fit in the mounting recess 27 of the housing main body 11. As shown in FIG. 1, recessed steps 65 are provided on the lower surface of the covering wall 63 and connect to the tab inserting portions 24 at the full locking position to guide the unillustrated tabs.

Figure 11:
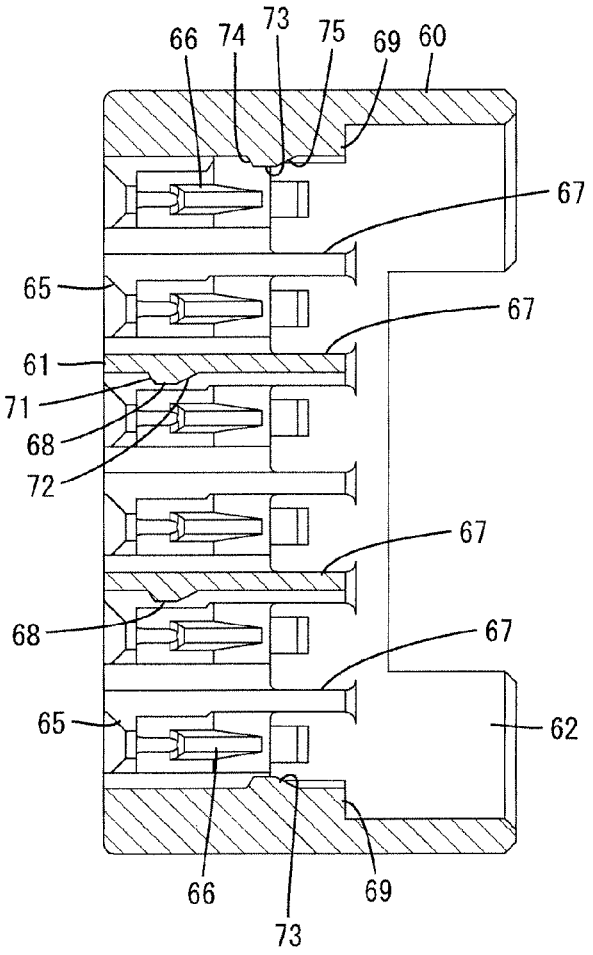
FIG. 11 is a section along B-B of FIG. 10.
Figure 12:
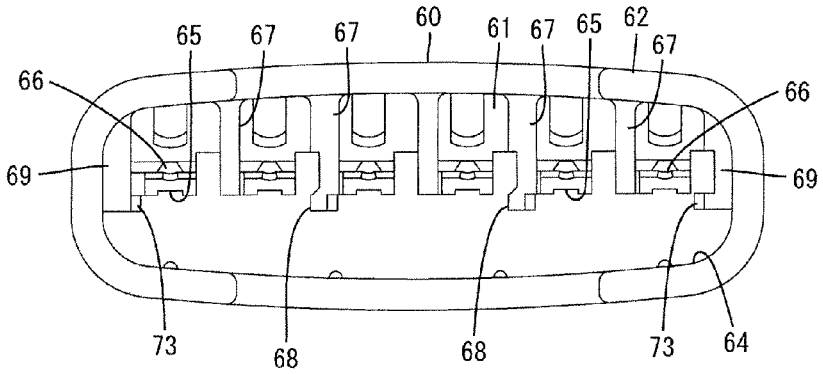
FIG. 12 is a rear view of the retainer.

As shown in FIGS. 11 and 12, restricting pieces 66 project on the rear surface of the covering wall 63 at positions corresponding to the respective cavities 21. The restricting pieces 66 are retracted to positions before deflection spaces 33 (see FIG. 7) formed above the locking lances 22 to allow deflection of the locking lances 22 when the retainer 60 is at the partial locking position. However, the restricting pieces 66 enter the deflection spaces 33 for the locking lances 22 to restrict the deflection of the locking lances 22 when the retainer 60 reaches the full locking position.

Partitioning walls 67 are provided on the rear surface of the covering wall 63 at opposite sides of each restricting piece 66, as shown in FIGS. 11 and 12. The partitioning walls 67 extend substantially vertically and are arranged side by side in the width direction at the same lateral positions as the corresponding partition walls 25.

As shown in FIG. 12, a full locking portion 68 projects from a lower part of each partitioning wall 67 located at opposite sides of the partitioning wall 67 in the widthwise center of the covering wall 63. The full locking portions 68 are at positions below the restricting pieces 66 and can enter into the full lock receiving portions 31. As shown in FIG. 11, each full locking portion 68 has a front full locking inclined surface 71 that inclines back toward a projecting end and a rear full locking inclined surface 72 that inclines forward toward the projecting end. An angle of inclination of the front full locking inclined surface 71 in the front-back direction is steeper than that of the rear full locking inclined surface 72.

End walls 69 are provided at outer sides of the restricting pieces 66 located on opposite widthwise sides on the rear surface of the covering wall 63. The end walls 69 are unitary with the peripheral wall 62 and extend vertically at substantially the same lateral positions as the opposite side walls 26.

As shown in FIG. 12, two partial locking portions 73 are provided on lower parts of the end walls 69 and are at positions below the restricting pieces 66. The partial locking portions 73 correspond to the side walls 26 that have the partial lock receiving portions 28 and can enter into the partial lock receiving portions 28. Further, the partial locking portions 73 are arranged at substantially the same position as the full locking portions 68 in the vertical, as shown in FIG. 12, and are behind the full locking portions 68 in the front-back direction, as shown in FIG. 11. Each partial locking portion 73 has a front partial locking inclined surface 74 that inclines back toward a projecting end and a rear partial locking inclined surface 75 that inclines forward toward the projecting end. An angle of inclination of the front partial locking inclined surface 74 in the front-back direction is steeper than that of the rear partial locking inclined surface 75. The angle of inclination of the front partial locking inclined surface 74 is substantially equal to that of the front full locking inclined surface 71 and the angle of inclination of the rear partial locking inclined surface 75 is substantially equal to that of the rear full locking inclined surface 72.

The retainer 60 is mounted into the housing main body 11 from the front. In the process of mounting the retainer 60, the peripheral wall 62 is fit externally on the front of the housing main body 11, the end walls 69 enter the guide grooves 29 and the partial locking portions 73 slide in the guide grooves 29. As shown in FIG. 2, the partial locking portions 73 fit resiliently into the partial lock receiving portions 28, as the retainer 60 reaches the partial locking position. In this way, the front partial locking inclined surfaces 74 of the partial locking portions 73 face and lock the front ends of the partial lock receiving portions 28 so that the retainer 60 cannot come out forward. Further, the partitioning portions 67 enter the guide holes 32 and the rear full locking inclined surfaces 72 of the full locking portions 68 contact the front surface of a part of the front wall 23 at a widthwise central side of the housing main body 11 to prevent the retainer 60 from moving back toward the full locking position.

As shown in FIG. 2, the front part of the retainer 60 that is at the partial locking position projects farther forward than the front end of the housing 10. Thus, external matter could easily interfere with the front wall 61 of the retainer 60 and could apply an external force on the retainer 60. There is a concern that such an external force on the covering wall 63 could arcuately deform the retainer 60 so that a widthwise central part of the retainer 60 projects toward the full locking position, and so that opposite widthwise sides of the retainer 60 move out sufficiently for the locked state of the partial locking portions 73 and the partial lock receiving portions 28 to be released.

However, in this embodiment, the full locking portions 68 are provided in the substantially widthwise central part of the retainer 60 and the rear full locking inclined surfaces 72 of the full locking portions 68 contact the facing front surface of the front wall 23 at the partial locking position, thereby preventing deformation of the widthwise central part of the retainer 60 to project toward the full locking position. As a result, the locked state of the partial locking portions 73 and the partial lock receiving portions 28 is maintained stably.

The terminal fittings 90 then are inserted into the cavities 21 of the housing main body 11 from behind, and the locking lances 22 primarily retain the properly inserted terminal fittings 90 in the cavities 21.

Figure 3:
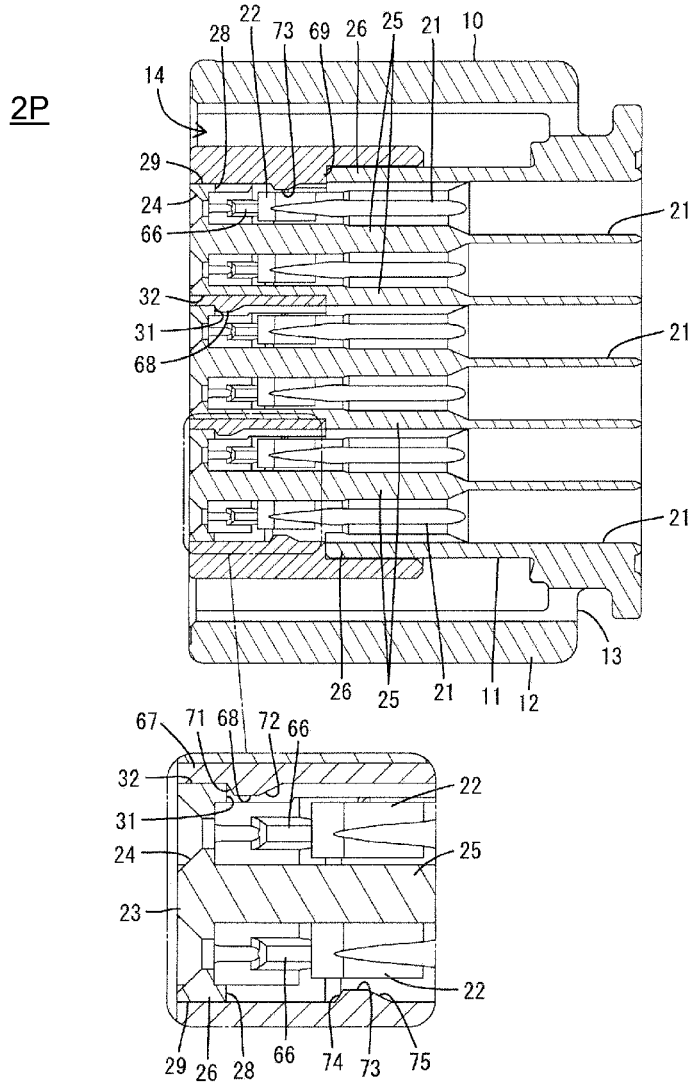
FIG. 3 is a section showing a state where the retainer is held at a full locking position with respect to the housing.

The retainer 60 then is pushed strongly back and moved toward the full locking position. In the process of moving the retainer 60 to the full locking position, the partial locking portions 73 escape into the partial lock receiving portions 28 and the full locking portions 68 are press-fit resiliently into the guide holes 32. As shown in FIG. 3, the full locking portions 68 come out from the guide holes 32 when the retainer 60 reaches the full locking position and are fit into the full lock receiving portions 31. Additionally, the front full locking inclined surfaces 71 of the full locking portions 68 face and lock the rear ends of the full lock receiving portions 31. In this way, the retainer 60 is prevented from moving forward toward the partial locking position. Further, the rear surfaces of the end walls 69 of the retainer 60 contact the front ends of the side walls 26 to prevent the retainer 60 from moving farther back than the full locking position. The restricting pieces 66 enter the deflection spaces 33 for the locking lances 22 when the retainer 60 reaches the full locking position to restrict the deflection of the locking lances 22. As a result, the terminal fittings 90 are retained secondarily and held in the cavities 21.

As described above, the full locking portions 68 contact the front wall 23 of the housing 10 in the widthwise central parts of the housing 10 and the retainer 60 when the retainer 60 is at the partial locking position to prevent the retainer 60 from moving to the full locking position. Thus, an inadvertent force cannot move the retainer 60 from the partial locking position to the full locking position.

The full lock receiving portions 31 and the partial lock receiving portions 28 are on different parts of the housing 10 (side walls 26 and partition walls 25) and the full locking portions 68 and the partial locking portions 73 are on different parts (partitioning portions 67 and end wall portions 69) of the retainer 60. Thus, a mold structure for molding the full lock receiving portions 31, partial lock receiving portions 28, full locking portions 68 and partial locking portions 73 is not particularly complicated.

The invention is not limited to the above described and illustrated embodiment. For example, the following embodiments are also included in the technical scope of the present invention.

The partial lock receiving portions may be provided on the partition walls different from those provided with the full lock receiving portions. Further, the partial lock receiving portions may be provided on both the partition walls and the side walls.

The partial locking portions may be provided on the partitioning portions different from those provided with the full locking portions out of the respective partitioning portions. Further, the partial locking portions may be provided on both the partitioning portions and the end walls.

The invention can be applied to a side retainer to be inserted into the housing in a direction intersecting with a connecting direction (front-back direction).

Contrary to the above embodiment, the partial lock receiving portions may be projections and the partial locking portions may be recesses. Further, contrary to the above embodiment, the full lock receiving portions may be projections and the full locking portions may be recesses.

LIST OF REFERENCE SIGNS

10 . . . housing
21 . . . cavity
25 . . . partition wall
26 . . . side wall
28 . . . partial lock receiving portion (first lock receiving portion)
31 . . . full lock receiving portion (second lock receiving portion)
60 . . . retainer
68 . . . full locking portion (second locking portion)
73 . . . partial locking portion (first locking portion)
90 . . . terminal fitting
1P . . . partial locking position (first position)
2P . . . full locking position (second position)

What is claimed is:

1. A connector, comprising:

a housing with cavities configured to receive terminal fittings, a second lock receiving portion provided on a widthwise intermediate part of the housing and first lock receiving portions provided on opposite widthwise end parts of the housing; and a retainer mounted to the housing and movable to a first position where insertion of the terminal fittings into the respective cavities is allowed and a second position reached by displacing the retainer at the first position and where the terminal fittings inserted in the respective cavities are prevented from coming out, a second locking portion provided on a widthwise intermediate part of the retainer and configured to contact a substantially facing wall surface of the housing at the first position for preventing movement of the retainer to the second position and to lock to the second lock receiving portion at the second position for preventing the retainer from returning to the first position, and first locking portions provided on one or more widthwise end parts of the retainer and configured to be locked to the first lock receiving portions at the first position for preventing the retainer from coming out of the housing.

2. The connector of claim 1, wherein the cavities are arranged substantially side by side in a width direction.

3. The connector of claim 2, wherein the cavities are at least partly partitioned by partition walls.

4. The connector of claim 3, wherein the second lock receiving portions and the first lock receiving portions are provided on different parts of the housing chosen from one or more side walls and one or more partition walls of the housing and wherein the second locking portions and the first locking portions are on different parts of the retainer chosen from one or more partitions and end walls of the retainer.

5. The connector of claim 1, wherein movement of the retainer to the second position is prevented by contact of the second locking portion (68) with a widthwise intermediate part of the front surface of the housing when the terminal fittings are inserted into the cavities and the retainer is mounted into the housing from the front and is located at the first position.

6. The connector of claim 1, wherein the second locking portion has a front second locking inclined surface inclined back toward a projecting end and a rear second locking inclined surface inclined forward toward the projecting end, an angle of inclination of the front second locking inclined surface is steeper than that of the rear second locking inclined surface.

7. The connector of claim 1, wherein the first locking portion is and the second locking portion are at substantially identical vertical positions and with the first locking portion being more rearward than the second locking portion.

8. The connector of claim 1, wherein the first locking portion has a front first inclined locking surface that inclines back toward a projecting end and a rear first locking inclined surface that inclines forward toward the projecting end, an angle of inclination of the front first locking inclined surface being steeper than that of the rear first locking inclined surface.

* * * * *